US005816413A

United States Patent [19]

Boccabella et al.

[11] Patent Number: 5,816,413

[45] Date of Patent: Oct. 6, 1998

[54] WIRE SCREEN DECK HAVING REPLACEABLE MODULAR SCREEN PANELS

[75] Inventors: Joseph L. Boccabella, Orangeville; Fred M. Goodhew; Peter A. Couturier, both of St. Catharines, all of Canada

[73] Assignee: W.S. Tyler, Canada, Ontario, Canada

[21] Appl. No.: 525,985

[22] Filed: Sep. 8, 1995

[51] Int. Cl.[6] ..... B07B 1/49

[52] U.S. Cl. ..... 209/399; 209/403

[58] Field of Search ..... 209/397, 399, 209/400, 401, 403, 405, 412

[56] References Cited

U.S. PATENT DOCUMENTS

| | | | |
|---|---|---|---|
| 3,101,314 | 8/1963 | Johnson . | |
| 3,255,885 | 6/1966 | Burls . | |
| 3,716,138 | 2/1973 | Lumsden . | |
| 3,795,311 | 3/1974 | Martin . | |
| 4,140,630 | 2/1979 | Scarlett et al. | 209/403 X |
| 4,375,408 | 3/1983 | Anderson . | |
| 4,380,494 | 4/1983 | Wilson . | |
| 4,430,211 | 2/1984 | Martin . | |
| 4,632,751 | 12/1986 | Johnson et al. . | |
| 4,670,136 | 6/1987 | Schmidt et al. | 209/403 |
| 4,728,422 | 3/1988 | Bailey | 209/399 X |
| 4,757,664 | 7/1988 | Freissle | 209/399 X |
| 4,795,552 | 1/1989 | Yun et al. . | |
| 4,826,017 | 5/1989 | Du Bourg et al. . | |
| 4,840,728 | 6/1989 | Connolly et al. . | |
| 5,045,184 | 9/1991 | Arkcles | 209/399 X |
| 5,112,475 | 5/1992 | Henry, Jr. | 209/403 X |
| 5,137,622 | 8/1992 | Souter | 209/403 |
| 5,213,217 | 5/1993 | Galton et al. | 209/399 |
| 5,219,078 | 6/1993 | Hadden . | |
| 5,328,036 | 7/1994 | Douglas . | |
| 5,341,939 | 8/1994 | Aitchison et al. . | |

*Primary Examiner*—D. Glenn Dayoan
*Attorney, Agent, or Firm*—Donald L. Beeson

[57] ABSTRACT

A screen deck for a vibrating screen apparatus is provided with a plurality of removable and interchangeable modular screen panels, including wire screen panels having pre-crimped screen wires pretensioned in both directions. The invention contemplates the use of interchangeable wire screen panels alone or in combination with polyurethane or rubber screen panels, and provides a screen deck that can be serviced relatively easily at relatively low cost.

20 Claims, 5 Drawing Sheets

WIRE SCREEN DECK HAVING REPLACEABLE MODULAR SCREEN PANELS

BACKGROUND OF THE INVENTION

The present invention generally relates to vibrating screen apparatus and more particularly to vibrating screens which employ wire screens.

Vibrating screens (sometimes called "screen separators") are widely used for material separation, including separation of solid materials into different sizes, separation of solids suspended in liquids, and removal of dirt and other contaminants from solids exposed to high pressure water rinses. Such apparatus typically employ one or more vibrating screen decks that provide extended screening areas using a selected screening media and screen mesh size suitable to the material separation application involved. High carbon steel wire screen are the most common screen media, since they provide a more efficient screening area (due to favorable wire diameter to hole size ratios) and since they can be used in both wet and dry screen applications and in all climatic conditions. Wire screens, however, have relatively poor wear characteristics and need to be repaired or replaced frequently. This normally requires removal of the entire screen which is a time consuming and costly operation.

To avoid the wear problems of wire screens, cast or injection-molded polyurethane screen panels are sometimes employed as the screening media of choice. An example of a polyurethane screen panel is shown in U.S. Pat. No. 5,045,184 to Arkles wherein molded modular polyurethane screen panels are employed on a screen deck using magnetic hold-downs. The disadvantage of polyurethane screens such as those disclosed in the Arkles patent is that, while they have excellent abrasion-resistent properties, they are relatively inefficient as compared to wire screen, and are relatively ineffective in dry applications and cold climatic conditions. Generally speaking, screen separators are either of the wire screen type, rubber, or the polyurethane type, depending on the application.

The above-mentioned disadvantages of wire screens, i.e., poor wear characteristics, are largely due to excessive whipping of the screen during the operation of the screen separator. Screen whipping can be the result of several conditions including insufficient clamping at the center of the screen, and failure to re-tension the screen after initial start up. Screen whipping also results from the fact that the intersecting pre-crimped wires of the screen are tensioned in one direction only. The wires in the opposite axis are relatively loose which causes the wires to vibrate excessively against each other, and, as a result, to abrade and ultimately fail. Even though such failures are normally localized and confined to a very small portion of the screen, the entire screen must be removed and normally replaced. For large screens, this requires mechanical lifting devices and several operators.

While wire screens that are pretensioned in both directions are known, such screens are limited to relatively small mesh screens (e.g. 20 mesh screens) employing wires which are not pre-crimped and which are attached to circular frames. Such screens are not generally suitable for the minerals benefication industry.

The present invention provides a screen deck construction for a vibrating screen apparatus which permits the use of the more efficient wire screens where desired, and which at the same time substantially reduces the cost associated with screen failure, including high screen replacement costs and lost production time during screen changeover. The present invention further permits polyurethane and rubber screen panels to be used together with the more efficient wire screens on the same screen deck in applications where these three screen types can be advantageously combined.

SUMMARY OF THE INVENTION

More specifically, the present invention involves a screen deck for a vibrating screen apparatus comprised of a screen panel support structure and a plurality of individual modular screen panels, each of which cover a portion of the screen panel support structure such that the support structure is covered by a pattern of contiguous and separately removable screen panels. At least one of the plurality of the screen panels is a wire screen panel comprised of a wire screen having an "x" and "y" axis and that is pretensioned along both of these axes. Screen panel hold-down means removably hold the screen panels to the screen support structure in at least one selected pattern of panels. If there is a localized failure in the screen, only the panel where such failure occurs needs to be repaired or replaced, not the entire screen. It is contemplated that such screen hold-down means will be adapted to not only hold wire screen panels of one or more sizes, but also polyurethane or rubber screen panels in conjunction with wire screen panels. Thus, in particular applications, several rows of more durable polyurethane screen panels can be provided at the screen deck's lead end to absorb the impact of material being fed onto the screen separator, while more efficient wire screen panels can be provided in the middle and at the discharge end of the deck.

The wire screen panels of the invention preferably include conventional pre-crimped wire screens attached to a metal frame comprised of "x" axis support members and "y" axis support members for pre-tensioning the screen wires in both the "x" and "y" axis directions. It is contemplated that the modular screen panels, including the wire screen panels, will all be rectangular in shape (including the possibility of the panel being square), such that the panels will readily fit together to form a continuous screening surface over the length and width of the screen deck. However, it is understood that a continuous screening surface could also be provided by panels of other shapes, such as L-shaped panels and triangular panels, so long as the panels can be arrayed on the panel support structure such that their edges are contiguous to each other without gaps through which unscreened material could fall.

It is further contemplated that the hold-down means for the modular screen panels can be in the form of conventional pin and sleeve hold-downs or magnetic hold-downs, or both. The portion of the hold-down means associated with the screen panel support structure would be located on the support structure at suitable intervals to accommodate panels of predetermined sizes.

Therefore, it is a primary object of the present invention to provide a wire screen vibrating apparatus wherein localized screen failures can be repaired with relative ease and with minimum down time. It is a further object of the present invention to provide a vibrating screen apparatus having a screen deck that can be configured for wire screen panels only, or a combination of wire screen panels and polyurethane and/or rubber screen panels, depending on the application. It is still a further object of the invention to provide a screen deck with wire screen panels having pre-crimped wires that are pretensioned in both directions. Other and further objects and advantages will be apparent from the following specification and claims.

DESCRIPTION OF THE DRAWINGS

FIG. 1 is broken away to show the screen decks of the apparatus.

DETAILED DESCRIPTION OF THE ILLUSTRATED EMBODIMENT

Figure 1:
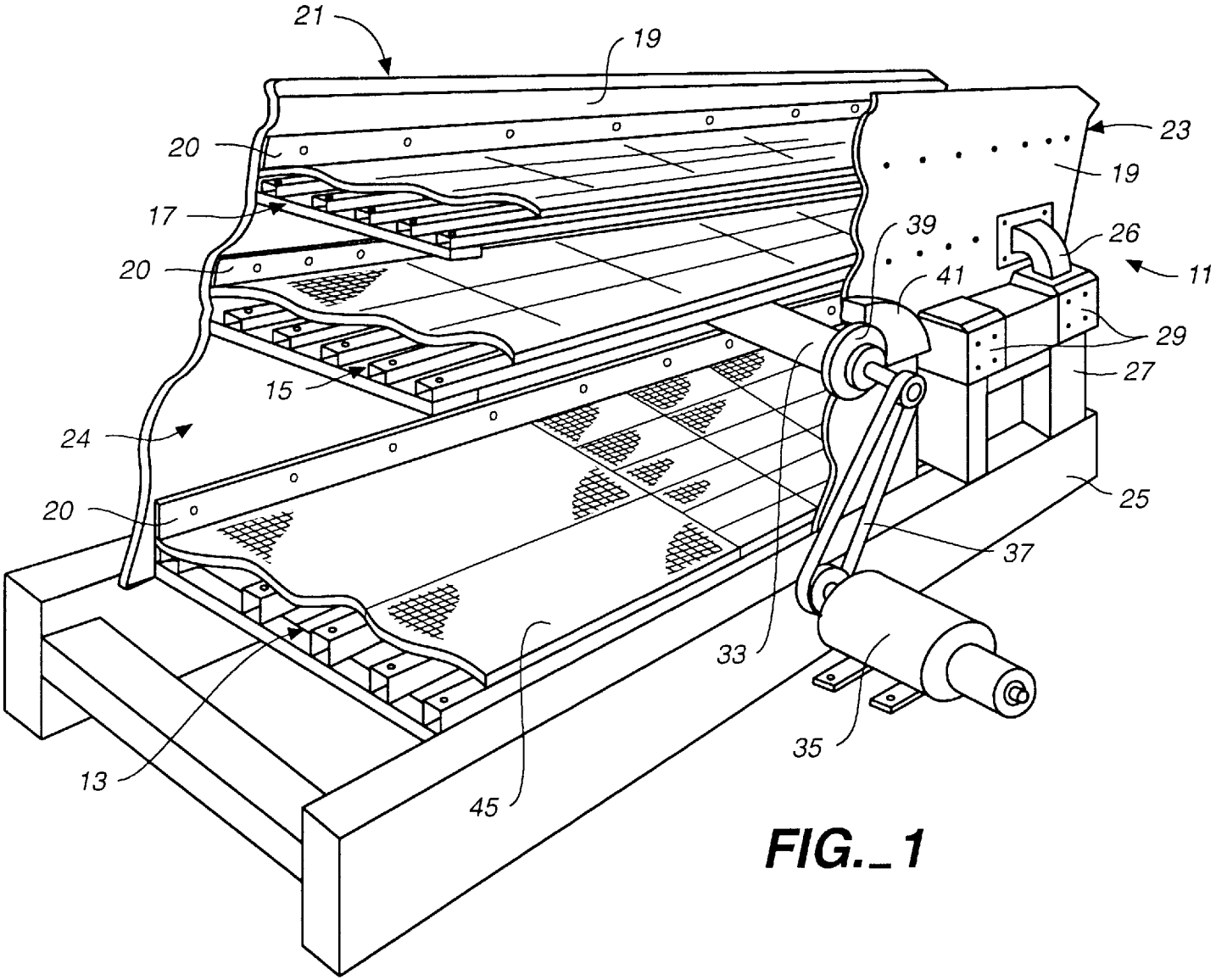
FIG. 1 is a top perspective view of a vibrating screen apparatus having three screen decks with modular screen panels in accordance with the invention.

Turning now to the drawings, FIG. 1 shows a vibrating screen separator 11 having three separate elongated screen decks 13, 15, 17 supported at three different convenient heights by opposed side walls 19 of a vibratory housing 21. The vibratory housing, which is rectangular in plan, has an end wall (not shown) at its material feed end 23, but is open at its discharge end 24 to permit the discharge of material captured by the screen decks.

The vibratory housing 21 and screen decks 13, 15, 17 form an integral vibratory screen basket which is supported on a stationary base frame 25 by means of screen basket suspension structures, such as the illustrated suspension structure 27, located at the four corners of the screen basket. Each of the screen basket suspension structures provide upstanding double rubber mounting units 29 through which the respective corners of the screen basket are resiliently mounted to base frame 25 using mounting bracket 26. The screen basket is driven in a vibratory motion by means of a rotating double eccentric shaft assembly 33 driven by motor 35 which is coupled to the shaft assembly via drive belt 37.

The screen separator of FIG. 1 operates in a manner well-known in the art. Material to be separated is fed into the feed end 23 of the screen basket 21 onto the topmost screen deck 17. A distributor (not shown) at the feed end suitably distributes the incoming material so as to provide a conditioned flow across the top of the screen deck. The mesh of each of the screen decks is made progressively smaller to progressively capture smaller-sized material as the material falls through the screens. The material caught by each screen is moved along the screen deck in the direction of the screen basket's discharge end 24 by vibratory motion imparted through the eccentric shaft assembly 33. It can be seen that this vibratory motion is a result of the eccentric 39 of the shaft assembly 33 acting against a "flywheel" 41 secured to the outside of the screen basket side walls 19.

Each of the screen decks of the screen separator 11 shown in FIG. 1 are seen to include, not a single wire screen as would be found on a conventional screen deck, but individual removable and interchangeable screen panels 45 which are shown in greater detail in FIGS. 2, 2A, 3, 3A, 3B and 4. Referring to the screen deck 49 illustrated in detail in FIGS. 2 and 2A, this screen deck is comprised of a screen panel support structure 51 which includes a series of upper, longitudinally extending and equally spaced support beams 53. Beams 53 are tied together into an integral support structure by means of lower cross beams 55 secured, such as by welding, across the bottoms of the upper support beams. Modular screen panels 57, 59 are supported atop the support structure's longitudinal support beams 53 so as to provide a continuous screening surface over the entire width of the deck from one end of the deck to the other.

Figure 2:
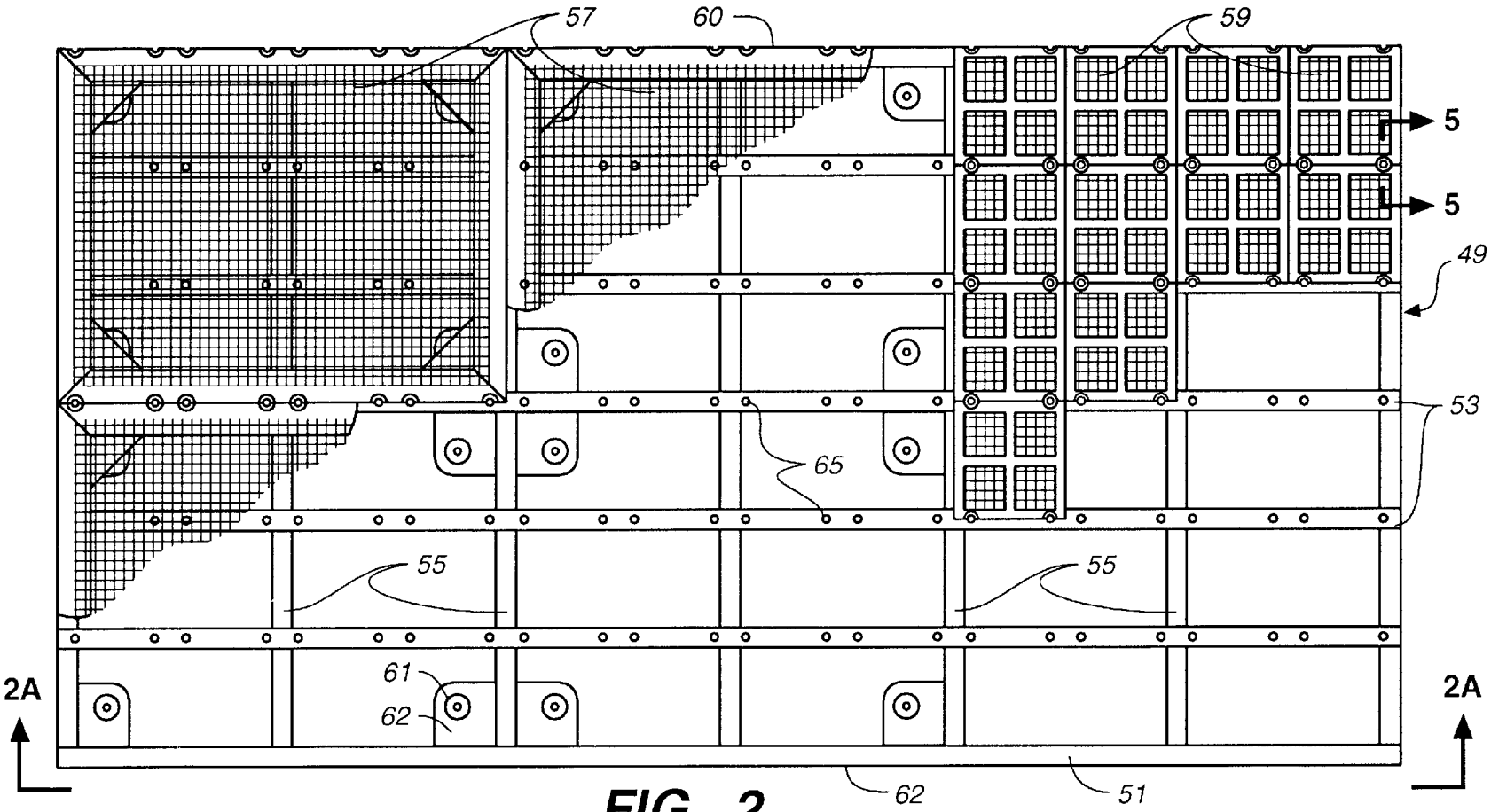
FIG. 2 is a top plan view of a screen deck in accordance with the invention showing a screen deck which combines the use of wire screen panels in accordance with the invention with smaller polyurethane screen panels.
Figure 2A:
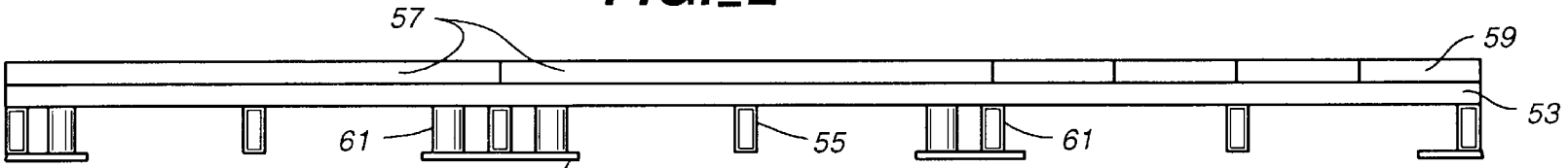
FIG. 2A is a side elevational view of the screen deck shown in FIG. 2.

As illustrated in FIGS. 2 and 2A, two types and sizes of screen panels are supported on the screen panel support structure, namely, the larger pre-crimped wire screen panels which cover the middle of the deck and the end of the deck closest the discharge end 24 of the screen separator apparatus shown in FIG. 1, and a larger number of smaller polyurethane screen panels 59 which cover the front portion of the deck to provide a polyurethane screening surface which is contiguous with the wire screening surface formed by the wire screen panels. In this configuration, the polyurethane screening surface will be the surface which receives the impact of incoming materials deposited on the screen deck where the highest abrasion and damage occurs.

The screen panel support structure is suitably dimensioned, and its upper support beams are suitably spaced, to receive screen panels of different sizes as shown. It is seen that the different-sized screen panels form a pattern of contiguous screen panels which cover the entire deck.

The screen deck illustrated in FIGS. 2 and 2A provides for two means for releaseably holding the modular screen panels to the screen panel support structure. One of the screen panel hold-down means consists of magnetic hold-down means to, in this case, hold the wire screen panels in place. The other hold-down means consists of conventional pin and sleeve hold-downs. Both of these hold-down means are described in greater detail below. However, it can be seen that the screen panel support structure provides components for the magnetic hold-down means in the form of electromagnets 61 deployed around the screen panel support structure at locations corresponding to the corners of those screen panels that are intended to be held down magnetically. Electromagnets 61 are held in place on the screen panel support structure by means of support plates 63 welded to the bottom of the support structure's cross beams at the selected hold-down locations. Suitably, the electromagnets can be bolted to support plates 63 as shown in FIG. 3B by means of a threaded anchor post provided on the bottom of the magnet. As for activating the electromagnets, controls can suitably be placed on a control panel (not shown) supported from the base of the machine. Changeover of panels held in this fashion can easily be initiated by simply reversing the polarity of the magnets from the control panel.

Selection of the electromagnets will depend on the application and the size and weight of the screen panels. Suitable commercially available electromagnets include circular electric CE and CLE series lift magnets manufactured by O. S. Walker of Worchester, Me.

The pin and sleeve hold-down means are provided on screen support structure 51 by means of sleeve holes 65 distributed along the tops of elongated support beams 53 which, like cross beams 55, are suitably rectangular steel tubes or channels. Sleeve holes 65 are spaced in correspondence with pin and sleeve cutouts on the screen panels.

It will be appreciated that a screen deck can be designed for both magnetic hold-down means only or pin and sleeve hold-down means only, or for both hold-down means as illustrated in FIG. 2. It will further be appreciated that the spacing and location of the hold-downs can be designed to meet a variety of design requirements involving screen panels of diverse sizes.

It should also be noted that a pin and sleeve hold-down cannot be accomplished along sides 60, 62 of screen deck 49 for the reason that no abutting screen panel edges are provided at these locations. Means for securing the screen panels along the sides of screen decks installed in a screen separator are shown in FIG. 1, wherein hold-down rails 20 removably attach, such as by carriage bolts, to the side walls 19 of vibratory housing 21, and thusly attached extend down to contact the sides of screen decks 13, 15, 17 in order to help hold the side-most panels of these screen decks in place.

Figure 3:
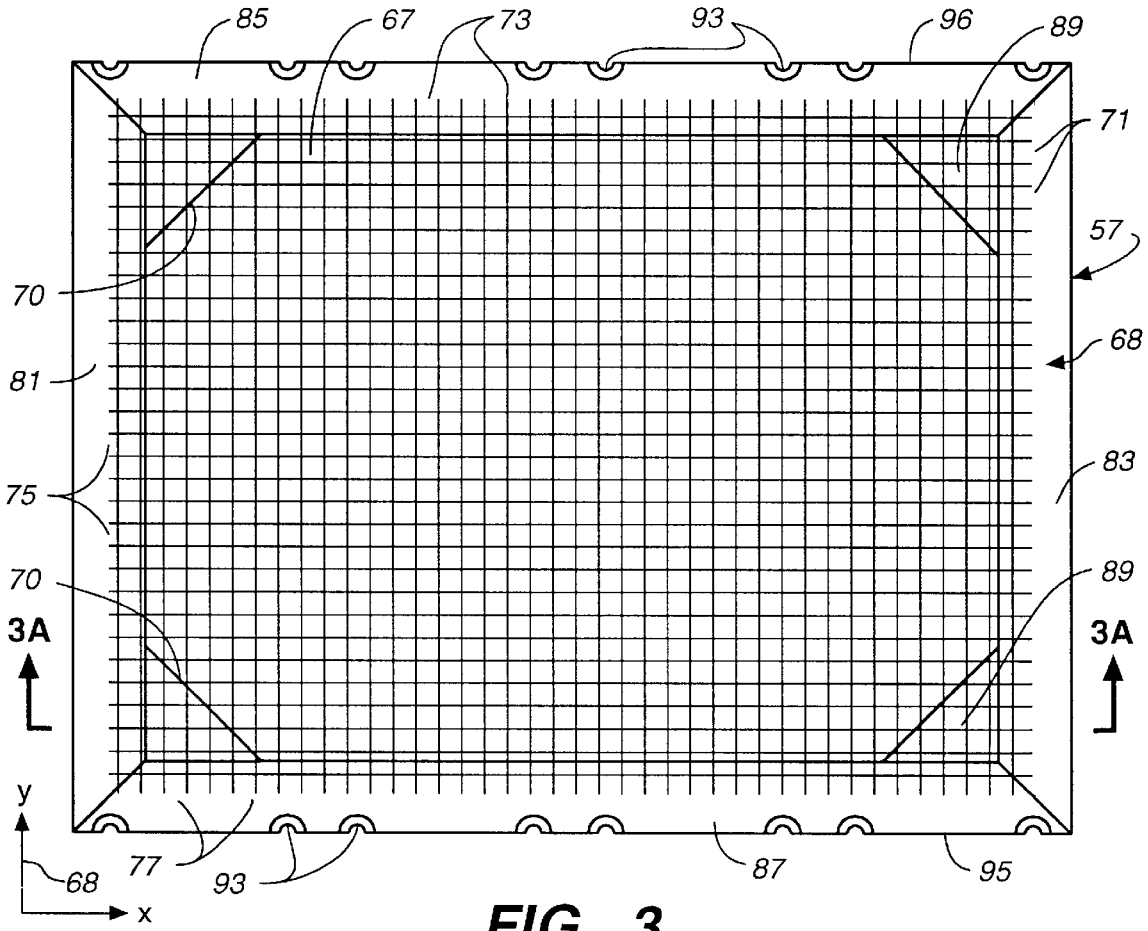
FIG. 3 is a top plan view of one of the wire screen panels shown in FIG. 2.
Figure 3A:
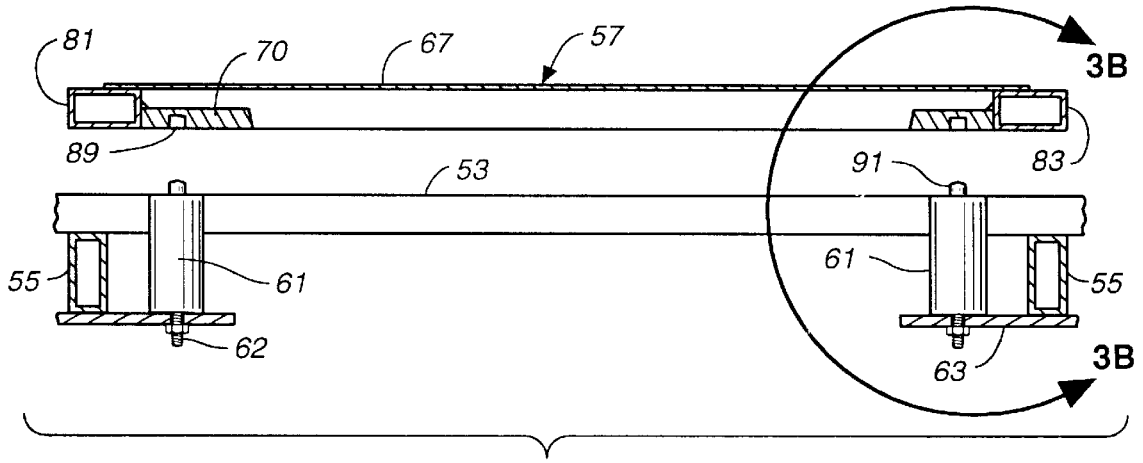
FIG. 3A is an exploded side elevational view of the wire screen panel shown in FIG. 3 taken along lines 3A—3A in FIG. 3, showing the installation of the screen panel over the hold-down magnets.
Figure 3B:
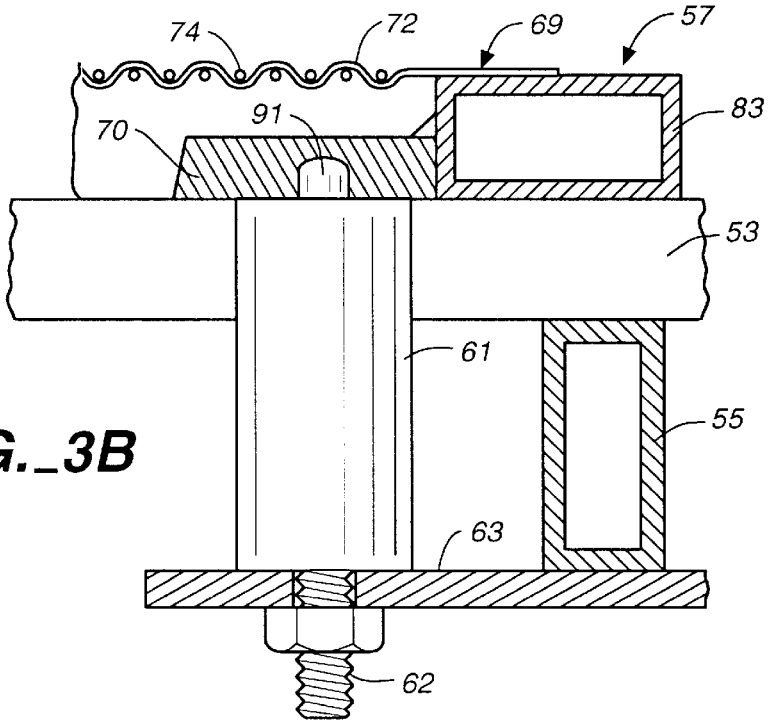
FIG. 3B is an enlarged fragmentary view in cross-section of the wire screen panel shown in FIG. 3A taken along lines 3B—3B, and more particularly showing the construction of the pre-crimped wire screen which attaches to the frame of the wire screen panel.

FIGS. 3, 3A, and 3B illustrate in greater detail the wire screen panels of the screen deck shown in FIGS. 2 and 2A and the magnetic hold-down means therefor. Each wire screen panel includes a wire screen of high carbon steel 67 for abrasion resistance, a frame 68 which is suitably fabricated of a low carbon steel for welding, and metal corner plates 70 secured, such as by welding, to the four interior corners of the frame. Screen cloth 67 further has an "x" and "y" axis (denoted by arrows 68 in FIG. 3) corresponding to the direction of the screen's intersecting wires 72, 74. Depending on the size of the screen deck and the application, these screen wires will typically range from 0.020 inches to 0.50 inches in diameter.

As shown in FIG. 3B, the screen cloth wires are pre-crimped—they are pre-crimped in both directions—in the manner conventional to wire screen cloths. The ends of the pre-crimped wires, such as the end 69 of pre-crimped wire 72 shown in FIG. 3B, form the wire screen's perimeter edges 71, 73, 75, 77 which are attached to and held by rectangular metal frame 68. More specifically, lateral perimeter edges 71, 75 attach to the frame's "x" axis screen support members 81, 83, and its longitudinal perimeter edges 73, 75 attach to the frame's "y" axis screen support members 85, 87. Because the screen wire cloth is preferably fabricated from high carbon steel, attachment of the screen edges to the frame is most suitably accomplished by a high strength adhesive, such as Plexus MA-550.

The wire screen panel shown in FIGS. 3, 3A, and 3B, additionally includes portions of the hold-down means for the screen panel. This includes magnetically attractable metal corner plates 70 having drilled holes 89 to accept a locator pin 91 of hold-down magnets 61. (Magnets 61 can suitably be secured to their respective support plates 63 by providing a threaded post 62 on the bottom of the magnet.) Features of the screen panel hold-down means further include cut-outs 93 drilled along the outside edges 95, 96 of y-axes screen support members 85, 87 for receiving the pin and sleeve hold-downs. Referring to FIG. 2, it can be seen that the holes for the pin and sleeve hold-downs are formed by the abutment of two screen panels together, such as along the panels outside edge 95, so that opposing cut-outs 93 are aligned. Thus, one row of pin and sleeve hold-downs acts to hold the edges of two adjacent screen panels.

It is noted that the screen 67 of wire screen panels 57 lies in a perfectly flat plane. This is to be contracted with the screen of a conventional screen deck which exhibits a crowning effect at the center of the screen. The crown of conventional screens increases the potential for wear and decreases efficiency.

Figure 4:
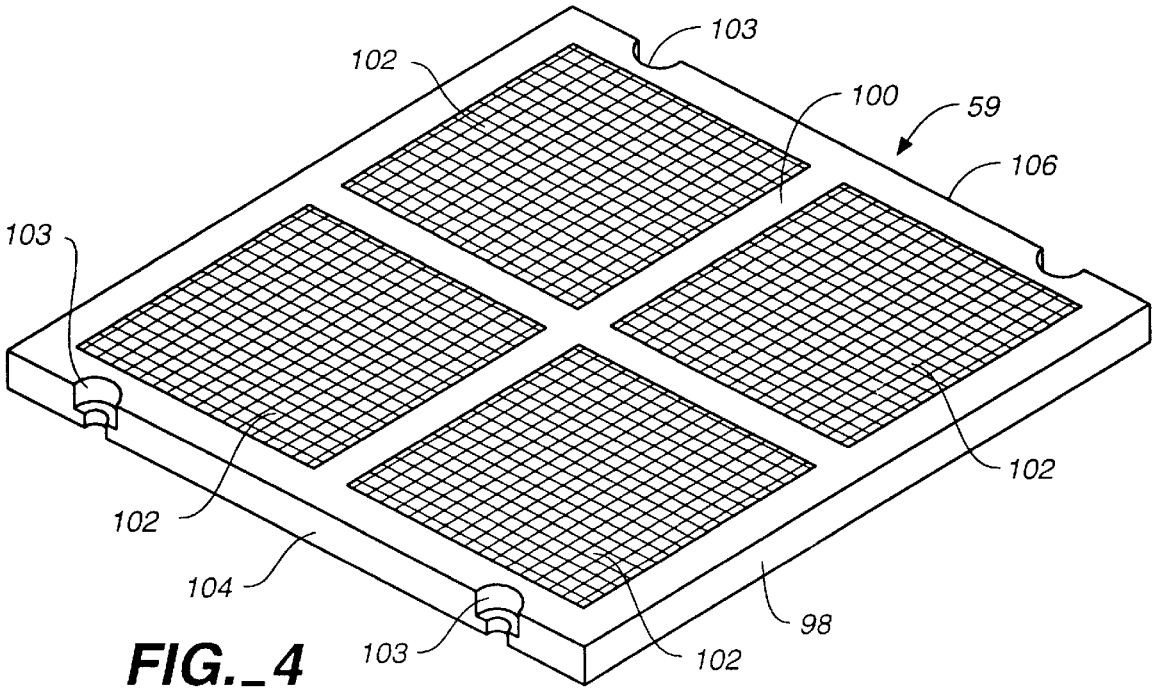
FIG. 4 is a top perspective view of polyurethane screen panel as shown in FIG. 2.

FIG. 4 shows in greater detail one of the polyurethane screen panels 59 shown in FIGS. 2 and 2A. This screen panel, which is a molded or cast part fabricated of polyurethane with an internal steel frame, has a perimeter portion 98 and integral cross-rib portions 100 supporting four integral screen segments 102. Pin and sleeve cut-outs 103 are formed along opposed lateral edges 104, 106 of the perimeter portion to provide for the pin and sleeve hold-down means. It is understood that a magnetic hold-down could alternatively or additionally be provided in connection with a polyurethane screen panel as shown in FIG. 4 by molding metal, magnetically attachable objects at the four corners, or elsewhere in the panel. Magnetic hold-down means for the polyurethane panel would, of course, require providing suitably placed magnets on the screen panel support structure 51.

Figure 5A:
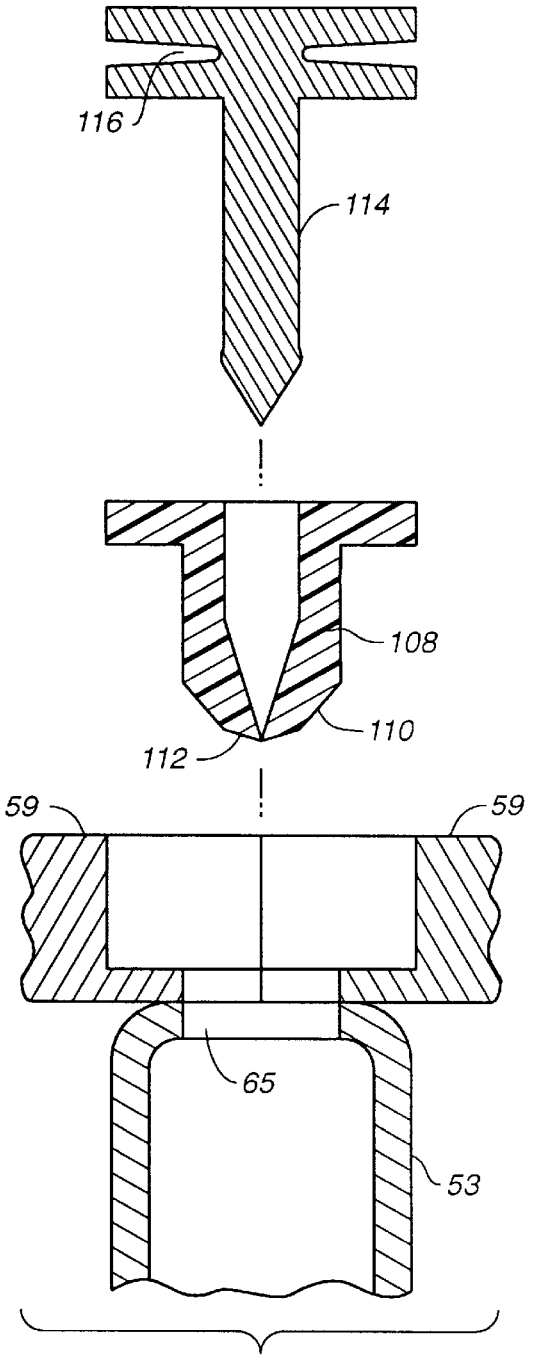
FIGS. 5A and 5B are exploded, cross-sectional views, in side elevation, of a pin and sleeve hold-down for a screen panel as shown in FIGS. 3 and 4.
Figure 5B:
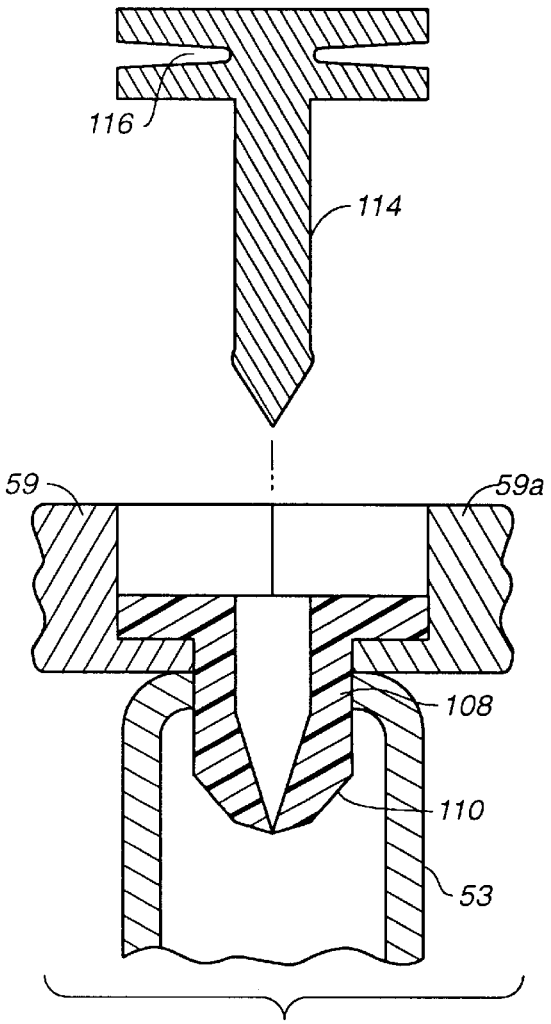
Figure 5C:
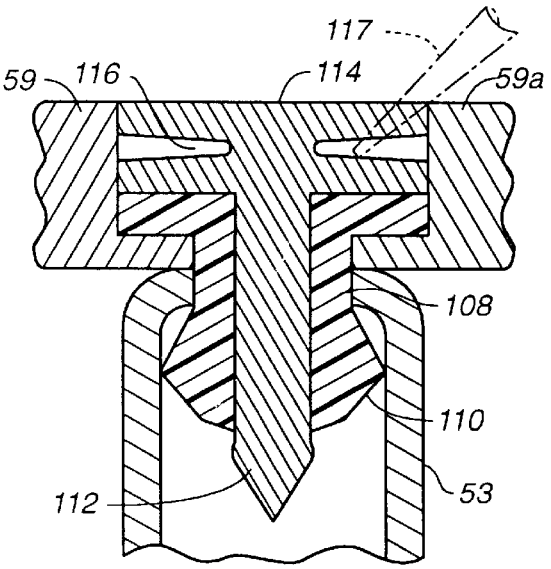
FIG. 5C is a cross-sectional view in side elevation of a pin and sleeve hold-down fully installed.

The pin and sleeve hold-down mechanisms are shown in greater detail in FIGS. 5A, 5B and 5C. The pin and sleeve hold-down includes a sleeve portion 108 having an expansion tip 110 which expands as pictorially shown in FIG. 5C when the extended post 112 of pin portion 114 is inserted into the sleeve. The pin and sleeve hold adjacent panels 59, 59*a* onto longitudinal support beam 53 as a result of the expansion of the sleeves 108 in sleeve holes 65. Removal of the screen panels using pin and sleeve hold-downs simply requires that the pin 114 of the hold-down be popped out of the sleeve by a screwdriver 115 or other similar tool by inserting the end of the screwdriver into perimeter slot 116 in the pliable head of the pin.

Therefore, it can be seen that the present invention provides a screen deck for a vibrating screen separator which is relatively easy to repair and which can be easily configured to meet different application requirements. Individual removable modular screen panels, including wire screen panels, are readily interchanged on the screen deck support structure. The invention substantially reduces the costs associated with screen replacement and repair and associated lost production time. It is contemplated that the invention can be used in a variety of materials separation applications and for screen mesh sizes up to a No. 2 mesh. While the best mode of the invention has been described in considerable detail in the foregoing specification and the accompanying drawings, it is understood that the invention is not intended to be limited to such detail, except as necessitated by the following claims.

What we claim is:

1. A screen deck for a vibrating screen apparatus comprising a screen panel support structure, a plurality of modular screen panels, each of said screen panels being sized to cover a portion of said screen panel support structure so as to fit together with other screen panels to form a pattern of contiguous screen panels on said screen panel support structure, at least one of said plurality of screen panels being a pre-crimped wire screen panel comprised of a frame having two opposed x-axis support members and two opposed y-axis support members, and a pre-crimped wire screen having perimeter edges and an "x" and "y" axis, the perimeter edges of said wire screen being attached to the x-axis and y-axis support members of said frame such that said wire screen is pretensioned along both the "x" and "y" axes thereof, and screen panel hold-down means for releaseably holding said screen panels to said screen panel support structure in at least one selected pattern of screen panels.

2. A screen deck for a vibrating screen apparatus comprising a screen panel support structure, a plurality of modular screen panels, each of said screen panels being sized to cover a portion of said screen panel support structure so as to fit together with other screen panels to form a pattern of contiguous screen panels on said screen panel support structure, at least one of said plurality of screen panels being a polyurethane screen panel and at least one of said plurality of said screen panels being a wire screen panel comprised of a wire screen cloth having an "x" and "y" axis, said wire screen cloth being pretensioned along both said "x" and "y" axes. and screen panel hold-down means for releasably holding said screen panels to said screen panel support structure in at least one selected pattern of screen panels.

3. The screen deck of claim 2 wherein said wire screen cloth is formed by pre-crimped screen wires.

4. The screen deck of claim 2 wherein said screen support structure is formed, and said screen hold-down means is adapted to receive screen panels of diverse sizes.

5. The screen deck of claim 2 wherein at least one of said screen panels is magnetically attractable, and wherein the screen panel hold-down means on said screen panel support structure include magnetic hold-down means for producing a magnetic hold-down force for said magnetically attractable panels.

6. The screen deck of claim 2 wherein said screen panel hold-down means includes both magnetic and mechanical hold-down means associated with said screen panel support structure for alternatively holding screen panels with complimentary magnetic hold-down means or screen panels with complimentary mechanical hold-down means.

7. A screen deck for a vibrating screen apparatus comprising a screen panel support structure, a plurality of modular screen panels each of said screen panels being sized to cover a portion of said screen panel support structure so as to fit together with other screen panels to form a pattern of contiguous screen panels on said screen panel support structure, said plurality of screen panels including a plurality of continuous wire screen panels covering a first portion of said screen support structure and a plurality of contiguous polyurethane screen panels covering a second portion of said screen panel support structure, said wire screen panels and polyurethane screen panels providing contiguously arranged polyurethane and wire screen surfaces across the screen deck, and each of said wire screen panels being comprised of a wire screen cloth having an "x" and "y" axis, said wire screen cloth being pretensioned along both said "x" and "y" axes, and screen panel hold-down means for releasably holding said screen panels to said screen panel support structure in at least one selected pattern of screen panels.

8. The screen deck of claim 7 wherein said polyurethane screen panels are positioned on said screen panel support structure such that the polyurethane screening surfaces of the screen deck receives the initial impact of a substantial portion of the materials deposited onto the screen deck.

9. The screen deck of claim 7 wherein said wire screen is formed by pre-crimped screen wires.

10. The screen deck of claim 7 wherein said screen support structure is formed, and said screen hold-down means is adapted to receive screen panels of diverse sizes.

11. The screen deck of claim 7 wherein at least one of said screen panels is magnetically attractable, and wherein the screen panel hold-down means on said screen panel support structure include magnetic hold-down means for producing a magnetic hold-down force for said magnetically attractable panels.

12. The screen deck of claim 7 wherein said screen panel hold-down means includes both magnetic and mechanical hold-down means associated with said screen panel support structure for alternatively holding screen panels with complimentary magnetic hold-down means or screen panels with complimentary mechanical hold-down means.

13. A screen deck for a vibrating screen apparatus comprising a screen panel support structure, a plurality of rectangular wire screen panels each having a metal frame comprised of x-axis support members and y-axis support members, and each including a separate pre-crimped wire screen having perimeter edges and an "x" and "y" axis, the perimeter edges of said screen being attached to the x-axis and y-axis support members of said frame to pretension said screen along both said "x" and "y" axes, each of said screen panels being sized to cover a portion of said screen support structure so as to fit together with other wire screen panels to form a pattern of contiguous wire screen panels on said screen panel support structure, and screen panel hold-down means for removably holding said screen panels to said screen panel support structure in at least one selected pattern of screen panels.

14. A wire screen panel for a screen deck of vibrating screen apparatus comprising a frame having at least two x-axis support members, and at least two y-axis support members, and a wire screen having pre-crimped x-axis wires and pre-crimped y-axis wires, said x-axis wires extending between and being attached to the x-axis support members of said frame so as to be pretensioned thereby, and said y-axis wires extending between the y-axis support members of said frame and being attached thereto so as to be pretensioned thereby.

15. The wire screen panel of claim 14 wherein said x-axis support members and y-axis support members form a rectangular frame for said pre-crimped wire screen.

16. The wire screen panel of claim 15 wherein said rectangular frame forms interior corners and wherein an interior corner plate fabricated of a magnetically attractable material is provided in at least one of said interior corners for providing at least one interior magnetic hold down point for the wire screen panel.

17. The wire screen panel of claim 16 wherein magnetically attractable corner plates are provided in all four corners of said rectangular frame.

18. The wire screen panel of claim 17 further including pin and sleeve cut-outs along at least one of said panel support members to permit pin and sleeve hold-down of the wire screen panel to the screen deck.

19. A wire screen panel of claim 14 wherein said pre-crimped x-axis wires and pre-crimped y-axis wires are fabricated of high carbon steel.

20. A wire screen panel of claim 19 wherein said x-axis and y-axis support members are fabricated of low carbon steel.

* * * * *